United States Patent [19]

Layh

[11] 4,377,365

[45] Mar. 22, 1983

[54] PIPELINE PADDING MACHINE AND METHOD

[76] Inventor: Ricky L. Layh, P.O. Box 2271, Hobbs, N. Mex. 88240

[21] Appl. No.: 200,991

[22] Filed: Oct. 27, 1980

[51] Int. Cl.[3] ..... E02F 5/22; B60P 1/36

[52] U.S. Cl. ..... 414/334; 37/142.5; 198/844; 414/346; 414/495; 414/528; 414/786

[58] Field of Search ..... 414/340, 343, 345, 346, 414/373, 489, 491, 495, 722, 725, 327, 528, 334, 786; 198/844, 616; 37/142.5; 405/179

[56] References Cited

U.S. PATENT DOCUMENTS 3,670,909 6/1972 Holland ..... 414/343 X 3,981,089 9/1976 Burrows ..... 37/142.5

4,055,255 10/1977 Vasquez ..... 414/725 X 4,055,265 10/1977 Eisenman ..... 414/528 X

*Primary Examiner*—Robert G. Sheridan

*Attorney, Agent, or Firm*—Marcus L. Bates

[57] ABSTRACT

A padding machine for transporting padding material from a dump truck into a pipeline ditch. The padding machine is supported forwardly of a vehicle. A bumper attached to the forward portion of the padding machine engages and pushes the rear end of a dump truck, while padding material is transferred from the dump truck into a upwardly opening trough which forms part of the padding machine. The floor of the trough is comprised of an upper run of a conveyor means, and continuously transports the padding material into the pipeline ditch.

15 Claims, 8 Drawing Figures

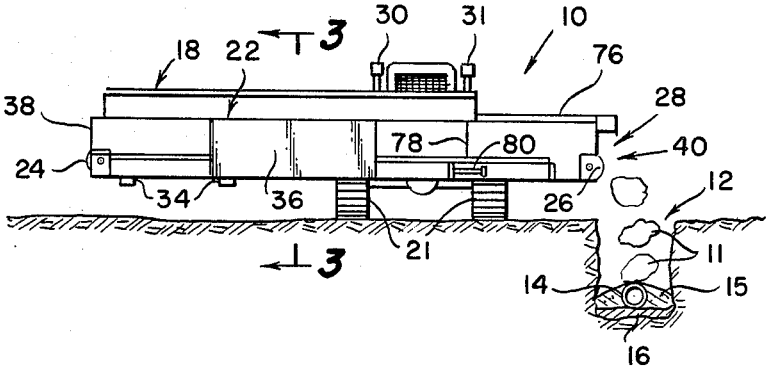
Fig. 1
Fig. 2
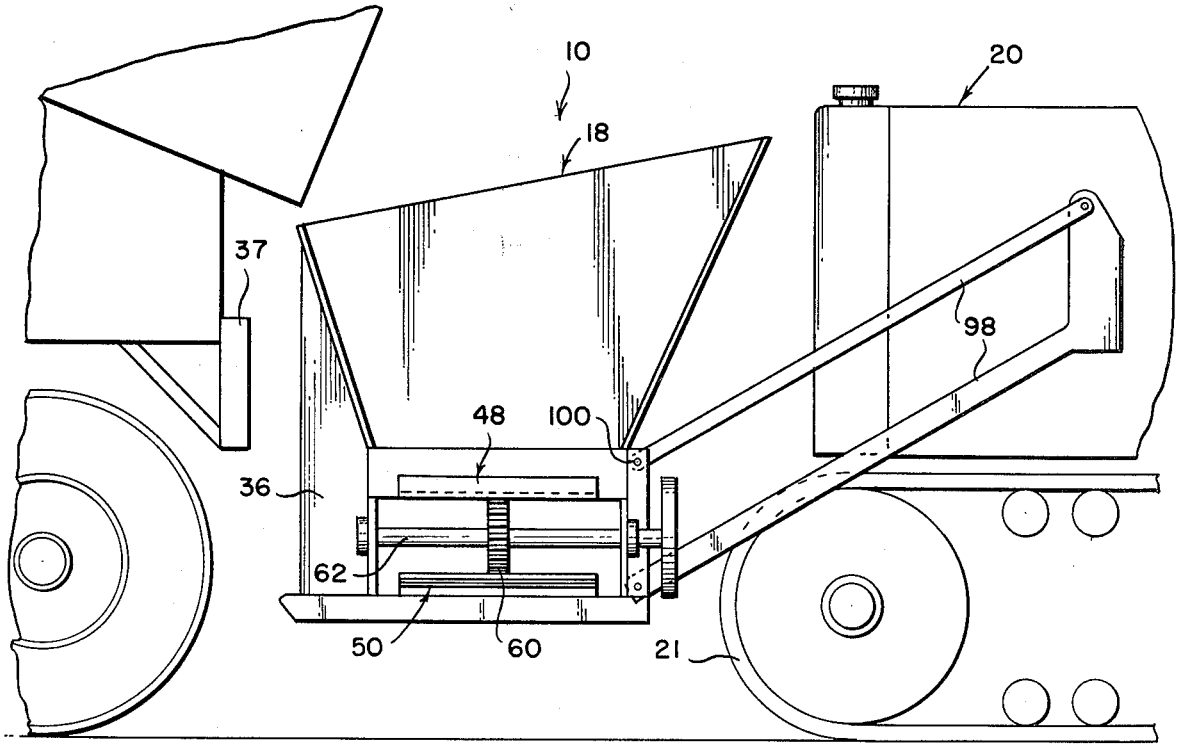

Fig. 3
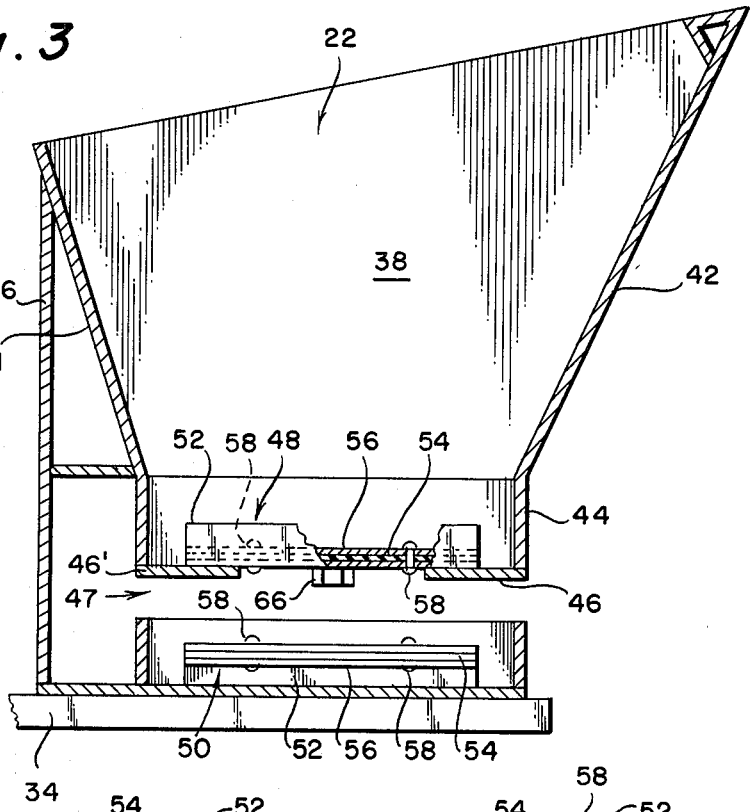
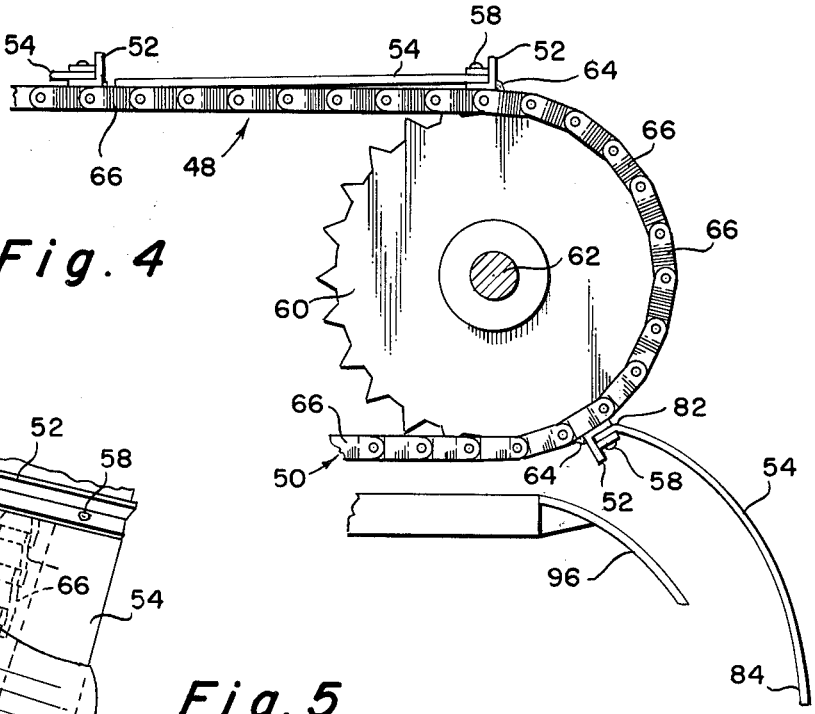
Fig. 4
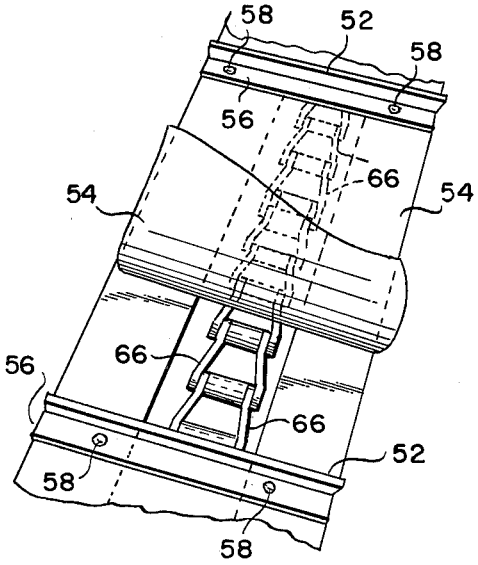
Fig. 5

Fig. 6
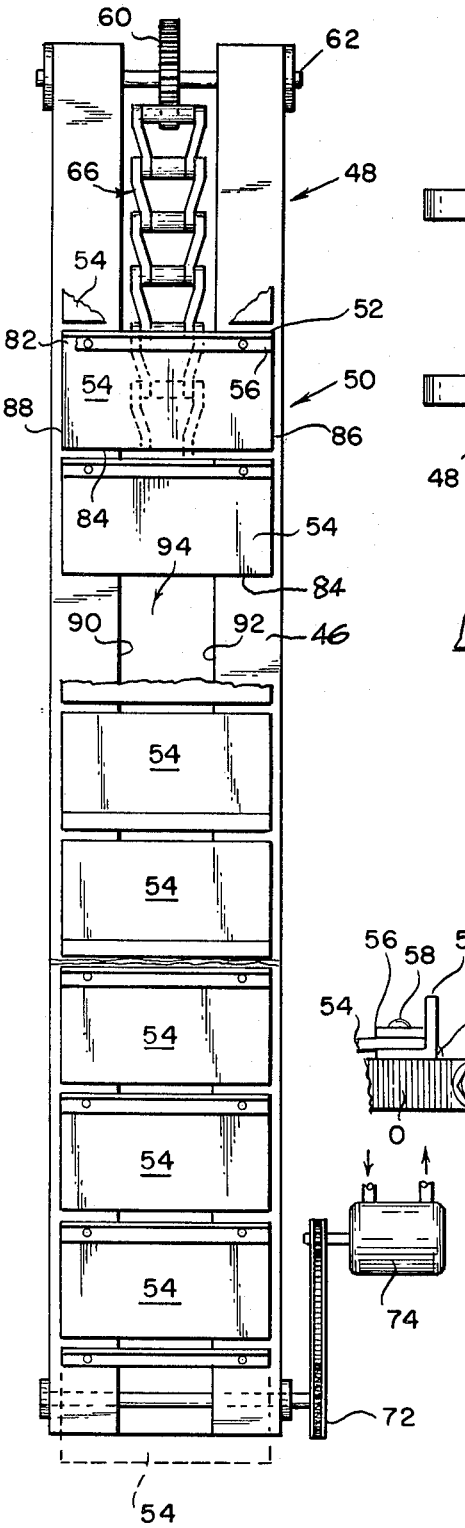
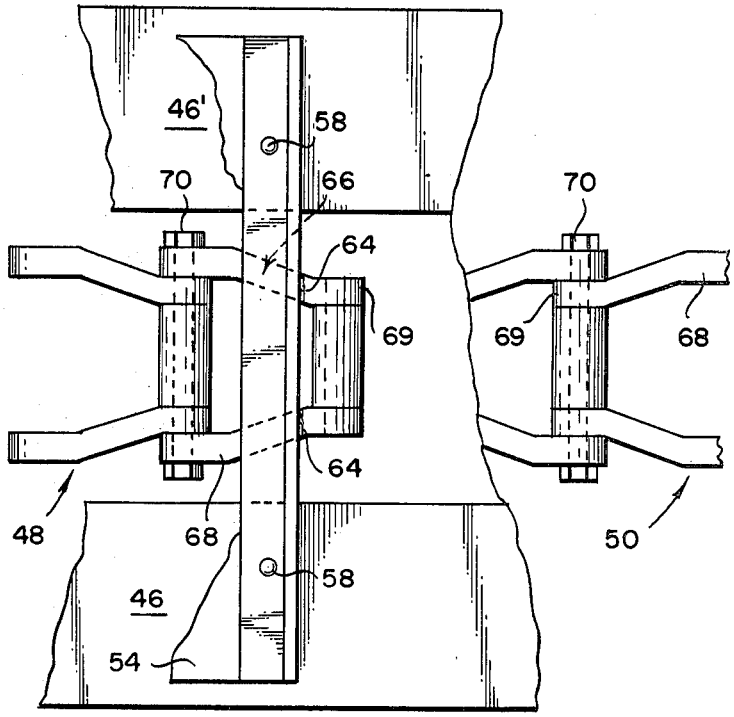
Fig. 7
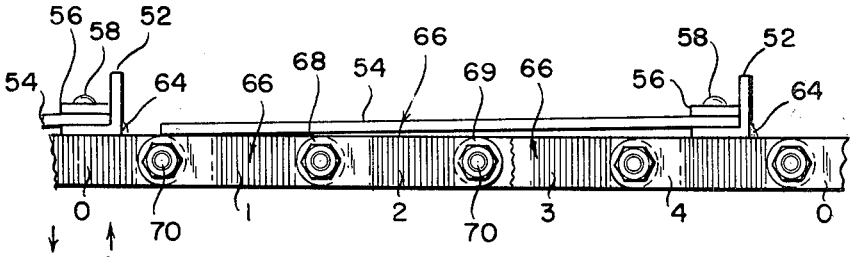
Fig. 8

PIPELINE PADDING MACHINE AND METHOD

BACKGROUND OF THE INVENTION

Cross country pipelines for conveying fluids over great distances are usually wrapped with a special protective material and placed in the bottom of a ditch. As the temperature of the pipe changes, contraction and expansion of the metal pipe causes lateral movement of the buried pipeline. It is, therefore, necessary to pad the pipeline with small aggregate material, such as sand or crushed caliche, to assure that the pipe does not rub against sharp objects, such as large rocks, for example, and become damaged.

Machines for uniformly spreading material from some sort of hopper are known to those skilled in the art, as evidenced by the following patents:

U.S. Pat. No. 2,584,322—Baldwin et al
U.S. Pat. No. 2,879,910—Johnson
U.S. Pat. No. 3,065,556—Kampert
U.S. Pat. No. 3,273,730—Moore
U.S. Pat. No. 3,804,278—James, III
U.S. Pat. No. 3,907,451—Fisher et al
U.S. Pat. No. 3,981,089—Burrows
U.S. Pat. No. 4,055,255—Vasquez Very few of the above cited prior art devices are suitable for padding long cross country pipelines in the manner contemplated by the present disclosure. In the Burrows patent, for example, it is necessary to include a massive hopper for holding padding material therewithin, and it is doubtful that the hopper could be recharged while the machine is concurrently transporting the padding material into the pipeline ditch.

The present invention makes available a padding machine which continuously transports padding material into a pipeline ditch while utilizing a conventional dump truck for metering the padding material into the trough thereof. The padding machine of this invention also includes improvements in a conveyor system which delivers the padding material into the bottom of the ditch and atop the pipe in a new and improved manner. The padding machine of this invention achieves new and unexpected results not found in the above prior art.

SUMMARY OF THE INVENTION

Method and apparatus for transporting padding material from a supply vehicle into a pipeline ditch. The apparatus of this invention is forwardly attached to a commercially available vehicle. The apparatus comprises an upwardly opening trough having an outlet end through which padding material flows into a pipeline ditch, and a framework which supports the trough and enables the trough to be manipulated by the vehicle. A bumper is mounted forwardly of the trough by which the supply vehicle is engaged and pushed as padding material is transferred from the supply vehicle into the trough.

A conveyor is arranged in underlying relationship respective to the trough. The conveyor includes sprocket means which are rotatably mounted at opposed ends of the trough. A plurality of chain links are connected together into an endless chain and meshed with the sprocket means. Means are provided for rotating one of the sprocket means, thereby moving the endless chain.

The upper and lower run of the endless chain supports a plurality of resilient flappers. The resilient flappers have opposed sides placed in close proximity to the sides of the hopper, and a forward and trailing end. A cross bar affixed to alternant chain links receive the forward end of the flapper in attached relationship thereto, thereby leaving most of the flapper freely extending therefrom, so that the flapper lays back on top of several of the links in superimposed relationship therewith. The flappers are arranged in end to end relationship so that they jointly form the moving bottom of the trough.

The floor of the trough has an elongated slot through which the chain links or conveyor elements attach to the flappers. The slot is formed by turning the bottom of the trough sidewalls toward one another to thereby also provide a surface which slidably supports the flappers.

The trough is arranged laterally respective to the ditch so that the vehicle which supports the padding machine transports the trough in a direction which lies parallel to the pipeline ditch, as padding material flows from the supply vehicle, into the trough, where the flappers laterally move the padding material through the trough outlet and into the ditch.

As the flappers move from the upper to the lower run, the padding material supported on the upper run of the conveyor is moved circumferentially about the inboard supporting sprocket and is thrust or thrown towards the bottom of the ditch. This action moves discreet quantities of padding material at finite intervals of time, with the padding material impacting into the ditch in an improved and advantageous manner.

A primary object of the present invention is the provision of a padding machine for moving padding material from a supply vehicle, laterally into a pipeline ditch.

Another object of the invention is the provision of a method by which padding material is continuously fed from a supply vehicle into a trough, where the padding material is conveyed laterally of the ditch while the trough moves parallel thereto, and the padding material is then placed into the ditch as discreet masses.

A further object of this invention is the provision of a lateral conveyor apparatus comprised of a plurality of adjacent resilient flappers having one end connected to a conveyor chain and the other end freely extending therefrom so that material is supported on the conveyor and laterally transported into a ditch in a new and unusual manner.

Another and still further object of this invention is the provision of a vehicle mounted conveyor for use in combination with a dump truck wherein the dump truck is pushed by the conveyor machine while padding material is continually transferred from the dump truck and into a trough, whereby the conveyor transports the padding material from the trough laterally into a pipeline ditch while the vehicle mounted conveyor is moved along a parallel path respective to the ditch, thereby providing a uniform covering of padding material within the ditch.

Another object of the present invention is to provide manipulation means for the trough of a padding machine, so that the padding machine can push a dump truck and at the same time position the trough thereof to receive padding material as the padding material is unloaded from the truck.

Another object of the present invention is to provide a slot in the bottom of a trough which is covered by a plurality of flappers attached to an endless chain in such a manner that the flappers form at least part of the floor of the trough.

Another object of the present invention is to provide a trough bottom comprised of a moving floor which covers a slot located in the bottom of the trough.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

BRIEF DESCRIPTION OF THE DRAWINGS

FIG. 1 is a front, elevational view of a padding machine made in accordance with the present invention, illustrated while operatively transporting padding material into a pipeline ditch;

FIG. 2 is an enlarged, fragmentary, side view of the present invention operatively associated with another vehicle;

FIG. 3 is an enlarged, cross-sectional view taken along line 3—3 of FIG. 1;

FIG. 4 is an enlarged, fragmentary, part cross-sectional view of part of the apparatus disclosed in FIGS. 1–3;

FIG. 5 is a fragmentary, perspective view of part of the apparatus disclosed in the foregoing figures;

FIG. 6 is a detailed, top plan view of part of the apparatus disclosed in FIGS. 1–3;

FIG. 7 is a fragmented, enlarged, detailed view of part of the apparatus disclosed in FIG. 6; and, FIG. 8 is a broken, detailed, side view of part of the apparatus disclosed in FIGS. 6 and 7.

DETAILED DESCRIPTION OF THE PREFERRED EMBODIMENT

In the figures of the drawings, there is disclosed a padding machine made in accordance with the present invention. As particularly seen in FIG. 1, the padding machine 10 is laterally transferring padding material 11 into a pipeline ditch 12. A pipeline 14 is positioned within the ditch and a layer of padding material 15 and 16 pads the pipe so that when the ditch is subsequently back filled with rocks and the like, the pipe is protected by the intervening padding material which surrounds the pipe.

As seen in FIGS. 1–3, the padding machine of the present invention includes an upwardly, opening trough 18 operatively mounted to a primary vehicle, preferably a crawler-type tractor 20 having tracks 21 of usual construction. Other type primary vehicles can be used for supporting and manipulating the trough, if desired. Padding material is charged into the opening 22 of the trough.

Bearing means 24 and 26 are operatively positioned at each end of the trough for supporting the upper run of an endless conveyor 28 therewithin. The primary vehicle includes hydraulic lift means 30 and 31 by which the conveyor can be vertically positioned respective to the ditch.

Skids 34 are positioned below the frame of the trough. A bumper 36 is positioned forwardly of the trough for contacting the rear of a transport vehicle, such as a truck bumper 37, as best seen illustrated in FIG. 2 of the drawings. The trough includes a closed end 38 and an outlet end 40.

As best seen in FIG. 3, together with other figures of the drawings, the trough preferably includes a relatively low forward wall 41 and a relatively high rear wall 42. The lower end of the trough is in the form of an open box 44 having inturned ledger plates 46. A space 47 is formed between an upper conveyor run 48 and a lower conveyor run 50.

The conveyor includes a plurality of cross bars 52. Each bar has attached thereto a resilient flapper member 54. A pressure clamp 56 attaches the flapper to the cross bar by means of the illustrated fastener 58.

As seen in FIG. 4, a sprocket 60 is mounted to a shaft 62, which in turn is mounted to the before mentioned bearings 26. A similar sprocket and shaft is mounted to the bearings 24. The cross bar is welded at 64 to alternant ones of a plurality of links 66 which form the endless conveyor chain.

As best seen disclosed in FIGS. 7 and 8, together with other figures of the drawings, the individual links 66 are bifurcated to form a Y-shaped member having legs 68 spaced apart from one another, and a single lug end 69 which is received between the legs of an adjacent link. The links are apertured for receiving connecting bolts 70 therethrough thereby pivotally connecting the links together. The links provide a traveling endless body to which the crossbars can be suitably welded.

A drive sprocket 72 is attached to one of the before mentioned shafts 62, and is chain driven by the illustrated sprocket which is attached to a hydraulic motor 74. Suitable hydraulic controls (not shown) are mounted onto the primary vehicle by utilizing the existing hydraulic pump and hoses of the tractor.

As seen in FIGS. 1 and 6, the marginal outlet end 76 of the trough is pivotally attached to the main support frame at coacting sidewalls which form a seam 78. Adjustment means 80 enables the end 76 of the trough to be elevated at an angle respective to the remainder of the apparatus so that the marginal outlet end 40 can be suitably positioned respective to the pipeline ditch.

As best seen illustrated in FIGS. 4 and 6, each of the flappers 54 include a fixed end 82 which is affixed to the crossbar, and a free end 84 which trails behind the crossbar and is superimposed over a plurality of the intervening links. The sides 86 and 88 of the flappers are slightly spaced from the sidewalls of the trough. The ledger plates 46 include longitudinally extending inner edge portions, 90 and 92, which are spaced apart from one another to provide a longitudinally extending slot 94 within which the endless chain is received so that the marginal opposed ends of the crossbars are supported on the upper face of the ledger plate, causing the adjacent flappers to form a continuous floor or bottom at the lower part of the trough.

In operation, the padding machine of the present invention is mounted forwardly of a hydraulically actuated support assembly, as for example, the mounting struts 98 which ordinarily are attached to a backloader. Attachment points 100 located at the trailing end of the main frame provides a suitable means by which the conveyor apparatus can be manipulated.

The primary vehicle 20 which supports the padding machine is positioned along one side of a pipeline ditch, with the trough thereof oriented laterally respective to the direction of travel of the vehicle and to the ditch. A dump truck of conventional design is placed into the operative position illustrated in FIG. 2 to enable padding material contained therewithin to be continually transferred into the trough as the truck is pushed along the ditch by the bumper 36 located on the forward sidewall of the trough. The hydraulic motor 74 is engaged, thereby imparting rotational motion into sprocket 72, shaft 62, and sprocket 60, thereby moving the endless conveyor 48 respective to the trough. The conveyor sprocket which is journaled at 26 is an idle sprocket. The dump truck bed is tilted to cause the padding material to continuously flow into the trough interior as the truck is pushed along a path which is parallel the pipeline ditch. At the same time, the floor of the trough moves laterally respective to the ditch, thereby depositing padding material about the pipe in the illustrated manner seen at 11 in FIG. 1.

As seen in FIG. 4, movement of the chain about the sprocket causes the flappers to be biased radially outwardly away from the end of the trough, thereby pushing the padding material supported thereon outwardly and downwardly, causing the padding material to impact against the bottom and sides of the ditch in discreet increments of material, as seen at 11 in FIG. 1, for example. This action more efficiently distributes the padding material about the pipe and into any crevice which may underlie the pipe, and reduces the number of voids left around the pipe.

A curved guide member 96 is attached to the end of the frame and placed in the path of the flappers, so that as the flappers are moved from the upper to the lower run, they are guided into the horizontal position indicated by the numeral 50 in FIG. 3.

I claim:

1. A machine for transferring padding material from a transport vehicle into a pipeline ditch, comprising:

an elongated upwardly opening trough for receiving padding material from the transport vehicle; an outlet formed at one end of the trough; a primary vehicle; means mounting said trough to said primary vehicle such that as the primary vehicle travels parallel to a pipeline ditch, the trough is laterally positioned respective to the ditch and is moved parallel to the ditch;

a plurality of chain links forming an endless conveyor chain, said trough includes upwardly directed sidewalls arranged parallel to the conveyor chain; manipulating means by which said trough is positioned respective to said primary vehicle; a bumper means located on a forwardly located trough wall in opposition to said manipulating means by which said trough can be lifted and transported by the manipulating means, while the bumper means can push a transport vehicle which is concurrently dumping padding material into the trough;

journal means at opposed ends of the trough by which said conveyor chain is supported for parallel movement respective to said trough; spaced flappers attached at spaced locations along the endless conveyor chain for supporting padding material thereon, and for moving the padding material towards one end of the trough;

said flappers have opposed sides, a forward edge, and a trailing edge spaced from said forward edge, means attaching the forward edge of said flappers to the chain with the flappers forming a substantially continuous trough bottom;

so that the padding material dumped into the trough by said transport vehicle is supported by the flappers and is conveyed toward the trough outlet where the padding material is directed into the pipeline ditch.

2. The machine of claim 1 wherein said means attaching the forward edge of the flapper to the endless chain is a lateral member affixed to a chain link, attachment means by which the forward marginal edge of the flapper is attached to the lateral member, thereby leaving the flapper rearwardly extending over a plurality of chain links, there being flapper members attached in spaced relationship along the entire chain length so as to form a continuous support and conveying member.

3. The machine of claim 2 wherein the lower marginal longitudinal edge of said sidewall turn inward and terminate in spaced opposed edges which form a lateral longitudinally extending slot, said spaced edges are aligned parallel to the chain, said chain provides an upper run and a lower run with the upper run being received within said lateral slot; the marginal opposed sides of said flapper slidably engage said spaced opposed edges.

4. The machine of claim 1 wherein the marginal end of the trough which is adjacent to the outlet includes means pivotally mounting the trough marginal end to the remaining structure so that the outlet end of the trough can be elevated respective to a pipeline ditch.

5. A padding machine having a main longitudinally extending frame which supports an upwardly opening trough having an outlet end through which padding material can flow, said trough includes fore and aft sidewall and a floor, and an end wall opposed to said outlet end;

lifting means connected at one side of the frame by which the padding machine can be manipulated by a primary vehicle; bumper means connected to the other side of the frame;

whereby a primary vehicle can lift the trough and transport the trough along the ground while the bumper means pushes a transport vehicle which charges the trough with padding material;

a sprocket means rotatably mounted in journaled relationship at each end of said trough, a plurality of links connected together into an endless chain and meshed with said sprocket means, means rotating one of said sprockets to impart relative longitudinal movement into said chain;

a longitudinally extending slot formed in said floor, a plurality of crossbars affixed to alternate links; a flapper member having opposed sides, a forward edge, and a rear edge, means affixing the forward marginal edge of one said flapper to one side crossbar thereby leaving the sides of the flapper disposed adjacent to the opposed trough sidewalls, with a free marginal end of the flapper being superimposed over a plurality of links, and with a plurality of the flappers jointly covering the slot and forming a moving support means for supporting and conveying padding material through the outlet end of the trough.

6. The machine of claim 5 wherein the lower marginal longitudinal edge of said sidewalls turn inward and terminate in spaced opposed edges which form said longitudinally extending slot, said spaced edges are aligned parallel to the chain, said chain provides an upper run and a lower run with the upper run being received within said lateral slot, the marginal opposed sides of said flapper slidably engage said spaced opposed edges.

7. Apparatus for padding pipe of the type which is propelled along a pipe ditch by a primary vehicle, the combination with said vehicle of a padding machine; said machine has a main longitudinally extending frame which supports an upwardly opening trough, the trough includes an outlet end through which padding material can flow, and further includes fore and aft sidewalls and a floor, and an end wall opposed to said outlet end;

lifting means located at one side of the frame by which the padding machine can be supported and moved in a vertical plane by the primary vehicle; bumper means connected to the other side of the frame whereby the primary vehicle can lift the trough and transport the trough along the ground while the bumper means engages and pushes a transport vehicle which can charge the trough with padding material while being pushed along the ground;

a conveyor support means rotatably mounted in journaled relationship at each end of said trough, a plurality of conveyor elements connected together into an endless conveyor and supported by said conveyor support means, means rotating one of said conveyor support means to impart relative longitudinal movement into said conveyor;

a longitudinally extending slot formed in said floor, a plurality of flapper members, each flappers member includes opposed sides, a forward edge, and a rear edge; means affixing the forward marginal edge of one said flapper member to one conveyor element, such that the sides of the flapper member are disposed adjacent to the opposed trough sidewalls, with a free marginal end of the flapper member being superimposed over a plurality of conveyor elements, and with there being a plurality of the flapper members affixed to a plurality of conveyor elements and jointly cooperating together to cover the slot and form a moving support means for supporting and conveying padding material through the outlet end of the trough.

8. The combination of claim 7 wherein said means attaching the forward marginal edge of the flapper member to the conveyor element is a lateral member affixed to one said conveyor element, attachment means by which the forward marginal edge of the flapper member is attached to the lateral member, thereby leaving the flapper rearwardly extending over a plurality of said conveyor elements, there being flapper members attached in spaced relationship along the entire conveyor length so as to form a continuous support and conveying member.

9. The combination of claim 7 wherein the lower marginal longitudinal edge of said sidewalls turn inward and terminate in spaced opposed edges which form part of said floor and said longitudinally extending slot, said spaced edges are aligned parallel to the conveyor elements and provide an upper run and a lower run with the upper run being received within said slot; the marginal opposed sides of said flapper slidably engage said spaced opposed edges.

10. In an apparatus for padding pipe of the type which is propelled along a pipe ditch by a primary vehicle, said vehicle supports a padding machine; said machine has a main longitudinally extending frame laterally arranged respective to the direction of travel thereof; said machine includes an upwardly opening trough, the trough includes an outlet end through which padding material can flow, and further includes fore and aft sidewalls and a floor, and an end wall opposed to said outlet end; the improvement comprising:

lifting means arranged at one side of the said frame by which said padding machine can be supported and lifted in a vertical plane by the primary vehicle; bumper means connected to the opposed side of said frame; whereby, the primary vehicle can lift the trough and transport the trough along the ground while the bumper means engages and pushes a transport vehicle which can charge the trough with padding material while being pushed along the ground;

a conveyor support means rotatably mounted in journaled relationship at each end of said trough, a plurality of conveyor elements connected together into an endless conveyor and supported by said conveyor support means, said endless conveyor forms an upper and a lower run, means rotating one of said conveyor support means to impart relative longitudinal movement into said upper and lower runs;

a longitudinally extending slot formed in said floor, a flapper member having opposed sides, a forward edge, and a rear edge; means affixing the forward marginal edge of one said flapper to one said conveyor element, thereby leaving the sides of the flapper disposed adjacent to the opposed trough sidewalls, with a free marginal end of the flapper being superimposed over a plurality of said conveyor elements, and with a plurality of the flappers jointly cooperating together to cover said slot and form a moving support means for supporting and conveying padding material through said outlet end of said trough.

11. The combination of claim 10 wherein said means affixing the forward edge of the flapper to the cross bar is a lateral member affixed to one said element and extending away from the element for moving padding material; said flapper members are attached in spaced relationship along the entire conveyor length so as to form a continuous support and conveying member.

12. The combination of claim 10 wherein the lower marginal longitudinal edge of said sidewalls turn inward and terminate in spaced opposed edges which form said slot, said spaced edges are aligned parallel to the conveyor; said endless conveyor provides an upper run and a lower run, with the upper run being received within said slot; the marginal opposed sides of said flapper slidably engage said lower marginal edge of said sides.

13. Method of transporting padding material from a transport vehicle into a ditch comprising the steps of:

(1) mounting an upwardly opening trough to a primary vehicle and moving the primary vehicle parallel to the ditch with the trough being oriented laterally respective to the direction of travel thereof;

(2) pushing the transport vehicle with the primary vehicle while the transport vehicle dumps padding material into the trough;

(3) arranging a trough outlet in overhanging relationship respective to the ditch so that padding material is transferred from the trough into the ditch;

(4) arranging sprockets at opposed ends of the trough; supporting an endless chain between the sprockets; and rotating one of the sprockets to cause the endless chain to move along the bottom of the trough;

(5) attaching one end of a resilient flapper member to alternate ones of the links of the endless chain to provide a trailing marginal free end of the flapper which covers a plurality of the chain links;

(6) placing a plurality of said flappers in close proximity to one another to form a continuous bottom in the trough;

(7) continuously moving the endless chain to cause the bottom of the trough to move parallel to the trough and laterally of the ditch;

(8) forming spaced ledger plates which extend along the length of the trough by extending the lower marginal ends of the trough sidewalls towards one another;

(9) terminating the ledger plates in spaced relationship respective to one another to form a slot which extends along the length of the trough;

(10) supporting the marginal sides of the flappers on the top of the ledger plates; and,

(11) receiving the endless chain within the slot.

14. The method of claim 13 and further including the steps of:

(8) attaching a crossbar to alternant chain lengths;

(9) attaching one end of said flapper to said crossbar; and,

(10) arranging said flappers along said chain to provide a continuous floor to said trough.

15. The method of claim 13 wherein the linear velocity of the endless chain is of a value to cause padding material transported thereon to be delivered from said outlet end in discrete masses of material as the flapper is carried about said sprocket at the outlet end.

* * * * *

UNITED STATES PATENT AND TRADEMARK OFFICE

CERTIFICATE OF CORRECTION

PATENT NO. : 4,377,365

DATED : March 22, 1983

INVENTOR(S) : Ricky L. Layh

It is certified that error appears in the above-identified patent and that said Letters Patent is hereby corrected as shown below:

Column 6, lines 13 and 31, "sidewall", each occurrence, should read -- sidewalls --.

Column 6. line 51, "side" should read -- said --.

Column 7, line 28, "flappers", second occurrence, should read -- flapper --.

Signed and Sealed this

Thirty-first Day of January, 1989

*Attest:*

DONALD J. QUIGG

*Attesting Officer*

*Commissioner of Patents and Trademarks*